US008068770B2

(12) United States Patent
Kurenuma et al.

(10) Patent No.: US 8,068,770 B2
(45) Date of Patent: Nov. 29, 2011

(54) TONER CARTRIDGE, IMAGE FORMING APPARATUS, METHOD OF RECYCLING TONER CARTRIDGE

(75) Inventors: Takeroh Kurenuma, Tokyo (JP); Fumio Ogata, Tokyo (JP); Seiji Terazawa, Tokyo (JP); Masayuki Yamane, Tokyo (JP); Kenzo Tatsumi, Tokyo (JP); Kiyonori Tsuda, Tokyo (JP); Emi Kita, Tokyo (JP); Nobuyuki Taguchi, Tokyo (JP); Satoshi Narumi, Tokyo (JP); Kazuhisa Sudo, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/848,607

(22) Filed: Aug. 2, 2010

(65) Prior Publication Data

US 2010/0296847 A1 Nov. 25, 2010

(30) Foreign Application Priority Data

Aug. 6, 2004 (JP) ..... 2004-230523
Aug. 20, 2004 (JP) ..... 2004-241566

(51) Int. Cl.
*G03G 15/08* (2006.01)

(52) U.S. Cl. ..... 399/262

(58) Field of Classification Search ..... 399/258, 399/260, 262
See application file for complete search history.

(56) References Cited

U.S. PATENT DOCUMENTS 4,611,899 A 9/1986 Kasamura et al.
5,184,181 A 2/1993 Kurando et al.
5,515,143 A 5/1996 Shiotani
5,520,229 A 5/1996 Yamada
5,530,531 A 6/1996 Girard
5,722,014 A 2/1998 Fike
5,867,757 A 2/1999 Okazaki et al.
5,890,040 A 3/1999 Matsuoka et al.
5,903,806 A 5/1999 Matsuoka et al.
5,991,584 A 11/1999 Meyer et al.
6,075,963 A * 6/2000 Ichikawa et al. ..... 399/262

(Continued)

FOREIGN PATENT DOCUMENTS

JP 05-107918 4/1993

(Continued)

OTHER PUBLICATIONS

Japanese Office Action issued Jan. 28, 2011 in Japanese Patent Application No. JP-2004-241566 filed Aug. 20, 2004 (with English translation).

(Continued)

*Primary Examiner* — Susan Lee
(74) *Attorney, Agent, or Firm* — Oblon, Spivak, McClelland, Maier & Neustadt, L.L.P.

(57) ABSTRACT

An insertion passage 104Y for inserting a suction nozzle 73Y fixed to an image forming apparatus is provided on a holder 102Y, and a connecting passage 114Y that connects the insertion passage 104Y and a toner storage section 106Y of the holder 102Y is provided. After the toner sent from bottle 101Y to the holder 102Y falls towards the connecting passage 104Y, the toner flows into the suction nozzle 73Y through the connecting passage 114Y and is then discharged out of the holder 102Y. An airtightness between the insertion passage 114Y and the suction nozzle 73Y inserted into the insertion passage 114 Y is superior than an airtightness between the bottle 101Y and the holder 102Y engaged with the bottle 101Y.

20 Claims, 7 Drawing Sheets

U.S. PATENT DOCUMENTS

| | | | | |
|---|---|---|---|---|
| 6,104,902 | A | 8/2000 | Meyer et al. | |
| 6,169,864 | B1 | 1/2001 | Baxendell et al. | |
| 6,229,973 | B1 * | 5/2001 | Wang et al. | 399/260 |
| 6,256,470 | B1 | 7/2001 | Taniyama et al. | |
| 6,259,877 | B1 * | 7/2001 | Taniyama et al. | 399/262 |
| 6,292,644 | B1 | 9/2001 | Goto et al. | |
| 6,298,208 | B1 | 10/2001 | Kawamura et al. | |
| 6,665,508 | B2 | 12/2003 | Sudo et al. | |
| 6,785,497 | B1 | 8/2004 | Hasebe | |
| D500,076 | S | 12/2004 | Takuwa | |
| 6,859,634 | B2 | 2/2005 | Itoh et al. | |
| 7,062,207 | B2 * | 6/2006 | Tsuda et al. | 399/260 |
| 7,076,192 | B2 * | 7/2006 | Tsuda et al. | 399/258 |
| 7,110,707 | B2 | 9/2006 | Nishitani | |
| 7,116,928 | B2 | 10/2006 | Muramatsu et al. | |
| D532,037 | S | 11/2006 | Tsuda et al. | |
| 7,221,891 | B2 | 5/2007 | Matsumoto et al. | |
| 7,245,852 | B2 | 7/2007 | Takuwa | |
| 7,248,824 | B2 | 7/2007 | Takami | |
| 7,277,664 | B2 | 10/2007 | Katsuyama et al. | |
| 7,313,349 | B2 | 12/2007 | Suzuki et al. | |
| 7,321,744 | B2 | 1/2008 | Hosokawa et al. | |
| 7,346,299 | B2 | 3/2008 | Muramatsu et al. | |
| 7,398,038 | B2 | 7/2008 | Tsuda et al. | |
| 7,450,891 | B2 | 11/2008 | Muramatsu et al. | |
| 7,480,476 | B2 | 1/2009 | Hosokawa et al. | |
| 7,536,139 | B2 | 5/2009 | Katsuyama et al. | |
| 7,542,703 | B2 | 6/2009 | Kasahara et al. | |
| D599,845 | S | 9/2009 | Kurenuma et al. | |
| 7,590,374 | B2 | 9/2009 | Takami | |
| 7,593,674 | B2 | 9/2009 | Matsumoto et al. | |
| 7,603,054 | B2 | 10/2009 | Katsuyama et al. | |
| 7,702,262 | B2 | 4/2010 | Taguchi et al. | |
| 7,706,699 | B2 | 4/2010 | Taguchi et al. | |
| 7,720,417 | B2 | 5/2010 | Taguchi et al. | |
| 7,822,371 | B2 | 10/2010 | Taguchi et al. | |
| 2002/0034398 | A1 | 3/2002 | Higeta et al. | |
| 2003/0081969 | A1 | 5/2003 | Muramatsu et al. | |
| 2003/0198488 | A1 | 10/2003 | Wang et al. | |
| 2003/0202823 | A1 | 10/2003 | Tamura | |
| 2003/0219263 | A1 | 11/2003 | Tsuzuki | |
| 2004/0184841 | A1 * | 9/2004 | Tsuda et al. | 399/258 |
| 2004/0228641 | A1 | 11/2004 | Rommelmann et al. | |
| 2005/0008400 | A1 | 1/2005 | Tazawa et al. | |
| 2005/0226655 | A1 | 10/2005 | Katsuyama et al. | |
| 2005/0226656 | A1 | 10/2005 | Tsuda et al. | |
| 2005/0254841 | A1 | 11/2005 | Tomitaka | |
| 2007/0122205 | A1 | 5/2007 | Taguchi et al. | |
| 2007/0147900 | A1 | 6/2007 | Taguchi et al. | |
| 2007/0154243 | A1 | 7/2007 | Taguchi et al. | |
| 2007/0154244 | A1 | 7/2007 | Taguchi et al. | |
| 2007/0212119 | A1 | 9/2007 | Kurenuma et al. | |
| 2007/0253745 | A1 | 11/2007 | Maruyama | |

FOREIGN PATENT DOCUMENTS

| | | |
|---|---|---|
| JP | 6-149047 | 5/1994 |
| JP | 8-272277 | 10/1996 |
| JP | 10-63078 | 3/1998 |
| JP | 2000-172060 | 6/2000 |
| JP | 2002-031943 | 1/2002 |
| JP | 2002-87591 | 3/2002 |
| JP | 2002-307737 | 10/2002 |
| JP | 2002-341648 | 11/2002 |
| JP | 2003-341759 | 12/2003 |
| JP | 2004-004559 | 1/2004 |
| JP | 2004-012687 | 1/2004 |
| JP | 2004-018138 | 1/2004 |
| JP | 2004-139031 | 5/2004 |
| JP | 2004-161371 | 6/2004 |
| JP | 2004-161373 | 6/2004 |
| JP | 2004-287404 | 10/2004 |

OTHER PUBLICATIONS

Taiwan Office Action No. 09920273500 dated Apr. 26, 2010 with English translation (8 pages).

Taiwan Office Action No. 09920343030 dated May 21, 2010 with English translation (9 pages).

Canadian Office Action for corresponding Canadian Application No. 2,548,556, dated Aug. 27, 2010.

U.S. Appl. No. 12/857,124, filed Aug. 16, 2010, Taguchi, et al.

U.S. Appl. No. 12/886,061, filed Sep. 20, 2010, Taguchi, et al.

* cited by examiner

Related Art

TONER CARTRIDGE, IMAGE FORMING APPARATUS, METHOD OF RECYCLING TONER CARTRIDGE

CROSS-REFERENCE TO RELATED APPLICATIONS

This patent application is a division of and claims the benefit of priority under 35 U.S.C. §120 from U.S. application Ser. No. 10/574,855 filed Mar. 26, 2007 which is the National Stage Entry of PCT/JP05/14793 filed Aug. 5, 2005, and claims the benefit of priority under 35 U.S.C. §119 from Japanese patent application nos. JP 2004-241566, filed on Aug. 20, 2004 and JP 2004-230523, filed on Aug. 6, 2004 in the Japan Patent Office, the entire contents of each of which are incorporated by reference herein.

TECHNICAL FIELD

The present invention relates to a technology for recycling toner cartridges of image forming apparatuses.

BACKGROUND ART

Image forming apparatuses generally employ an electrophotography method or a direct recording method to form toner images on a recording medium. Copiers, facsimile machines, printers are the examples of an image forming apparatus.

In the electrophotography method, a toner image is formed first on a latent image carrier, such as a photosensitive drum, and then the toner image is transferred to a recording medium. Japanese Patent Application Laid-open Publication No. 2002-307737 describes the direct recording method. In the direct recording medium, a toner image is directly formed on a recording medium.

Because toner is consumed as images are formed, it is necessary to periodically replenish the toner. In general, when replenishing the toner, the old and empty toner cartridge is replaced with a new and full toner cartridge. To reduce the frequency of replacement of the toner cartridge, it is better that the toner cartridges have a larger capacity to accommodate the toner. Japanese Patent Application Laid-open Publication No. 2004-18138 and Japanese Patent Application Laid-open Publication No. 2004-139031 disclose various toner cartridges.

FIG. 16 is a schematic of a toner replenishing unit of an image forming apparatus described in Japanese Patent Application Laid-open Publication No. 2004-18138. In this conventional art, the toner cartridge is set vertically in the image forming apparatus. However, this structure limits the freedom of layout.

FIG. 17 is a perspective view of a toner cartridge disclosed in Japanese Patent Application Laid-open Publication No. 2004-139031. This toner cartridge is set horizontally in an image forming apparatus. However, this toner cartridge can be attached or detached only from the upper side of the image forming apparatus.

DISCLOSURE OF INVENTION

Summary of Invention

A first object of the present invention is to provide a toner cartridge that can be installed in and detached from the side surface of an image forming apparatus, and that can be set not only vertically but also horizontally.

A second object is to provide a toner cartridge that is configured to prevent misalignment of the receptacle holding member due to the rotation of the toner receptacle, and that can be set not only vertically but also horizontally.

A third object is to provide a toner cartridge that is configured to discharge a stable amount of toner to the image forming apparatus, and that can be set not only vertically but also horizontally so as to allow freedom in the layout.

The above and other objects, features, advantages and technical and industrial significance of this invention will be better understood by reading the following detailed description of presently preferred embodiments of the invention, when considered in connection with the accompanying drawings.

Means for Solving Problem

According to an aspect of the present invention, a toner cartridge includes a toner receptacle configured to accommodate toner, the toner receptacle having an opening, and a receptacle holding member engaged with the toner receptacle such that the receptacle holding member covers or closes the opening and holds the toner receptacle rotatably, and as the toner receptacle rotates, toner in the toner receptacle passes to the receptacle holding member via the opening, wherein the receptacle holding member includes a pipe insertion section on which an insertion passage is formed to insert a pipe member configured to be fixed to an image forming apparatus, and is formed such that the insertion passage extends along a direction parallel to a direction of axis of rotation of the toner receptacle.

According to another aspect of the present invention, an image forming apparatus includes a toner image forming unit that forms a toner image on a recording body, a toner cartridge that accommodates toner to be supplied to the toner image forming unit and is detachable from the image forming apparatus, and a suction unit that sucks the toner in the toner cartridge and carries the toner to the toner image forming unit, wherein the toner cartridge includes a toner receptacle configured to accommodate toner, the toner receptacle having an opening, and a receptacle holding member engaged with the toner receptacle such that the receptacle holding member covers or closes the opening and holds the toner receptacle rotatably, and as the toner receptacle rotates, toner in the toner receptacle passes to the receptacle holding member via the opening, wherein the receptacle holding member includes a pipe insertion section on which an insertion passage is formed to insert a pipe member configured to be fixed to an image forming apparatus, and is formed such that the insertion passage extends along a direction parallel to a direction of axis of rotation of the toner receptacle, wherein the suction unit sucks the toner in the receptacle holding member through the pipe member inserted into the insertion member.

According to still another aspect of the present invention, an image forming apparatus uses a toner cartridge including a toner receptacle configured to accommodate toner, the toner receptacle having an opening; and a receptacle holding member engaged with the toner receptacle such that the receptacle holding member covers or closes the opening and holds the toner receptacle rotatably, and as the toner receptacle rotates, toner in the toner receptacle passes to the receptacle holding member via the opening, wherein the receptacle holding member includes a pipe insertion section on which an insertion passage is formed to insert a pipe member configured to be fixed to an image forming apparatus, and is formed such that the insertion passage extends along a direction parallel to a direction of axis of rotation of the toner receptacle, wherein a connecting passage connects the insertion passage and a toner storage section in the receptacle holding member, and after toner sent from the toner receptacle to the receptacle holding member drops to the connecting passage, the toner flows into the pipe member through the connecting passage to be discharged out of the receptacle holding member, and an airtightness between the insertion passage on a downstream side in a direction of transportation of toner from the connecting passage and the pipe member inserted into the insertion passage is superior than an airtightness between the toner receptacle on an upstream side in the direction of transportation of toner from the connecting passage and the receptacle holding member, the image forming apparatus includes a carrier unit that carries the toner from the receptacle holding member to the toner image forming unit via the pipe member by sucking the toner in the receptacle holding member through the pipe member.

According to another aspect of the present invention, a method of recycling a toner cartridge includes a toner receptacle that accommodates toner and a receptacle holding member engaged with the toner receptacle such that the receptacle holding member covers an opening formed in the toner receptacle and holds the toner receptacle so that the toner receptacle can rotate, in which after the toner in the toner receptacle is sent to the receptacle holding member from the opening by rotation of the toner receptacle, the toner is discharged out of the receptacle holding member and then the toner is refilled in the toner receptacle, wherein the receptacle holding member includes a pipe insertion section on which an insertion passage is formed to insert a pipe member configured to be fixed to an image forming apparatus, and is formed such that the insertion passage extends along a direction parallel to a direction of axis of rotation of the toner receptacle, the method includes removing the toner receptacle from the receptacle holding member, refilling the toner in the toner receptacle after removing, and setting the toner receptacle on the receptacle holding member upon refilling.

DESCRIPTION OF REFERENCE NUMERALS

1Y, 1M, 1C, 1K process cartridge (a part of toner-image forming unit)
20 optical writing unit (a part of toner-image forming unit)
40 transferring unit (a part of toner-image forming unit)
70 toner replenishing unit
71Y cartridge engaging section (a part of positioning member)
73Y suction nozzle (pipe member)
75Y positioning pin (protrusion)
100Y, 100M, 100C, 100K toner cartridge
101Y bottle (toner receptacle)
102Y holder (receptacle holding member)
104Y nozzle inserting section (inserting section)
105Y cap (a part of engaging section)
106Y toner storage section (a part of engaging section)
107Y O ring (non-porous sealing member)
114Y connecting passage

BEST MODE(S) FOR CARRYING OUT THE INVENTION

Exemplary embodiments of the present invention will be described below with reference to accompanying drawings. The present invention is not limited to these embodiments.

An embodiment of an electrophotographic printer (hereinafter, "printer") is described below as an image forming apparatus to which the present embodiment is applied.

Figure 1:
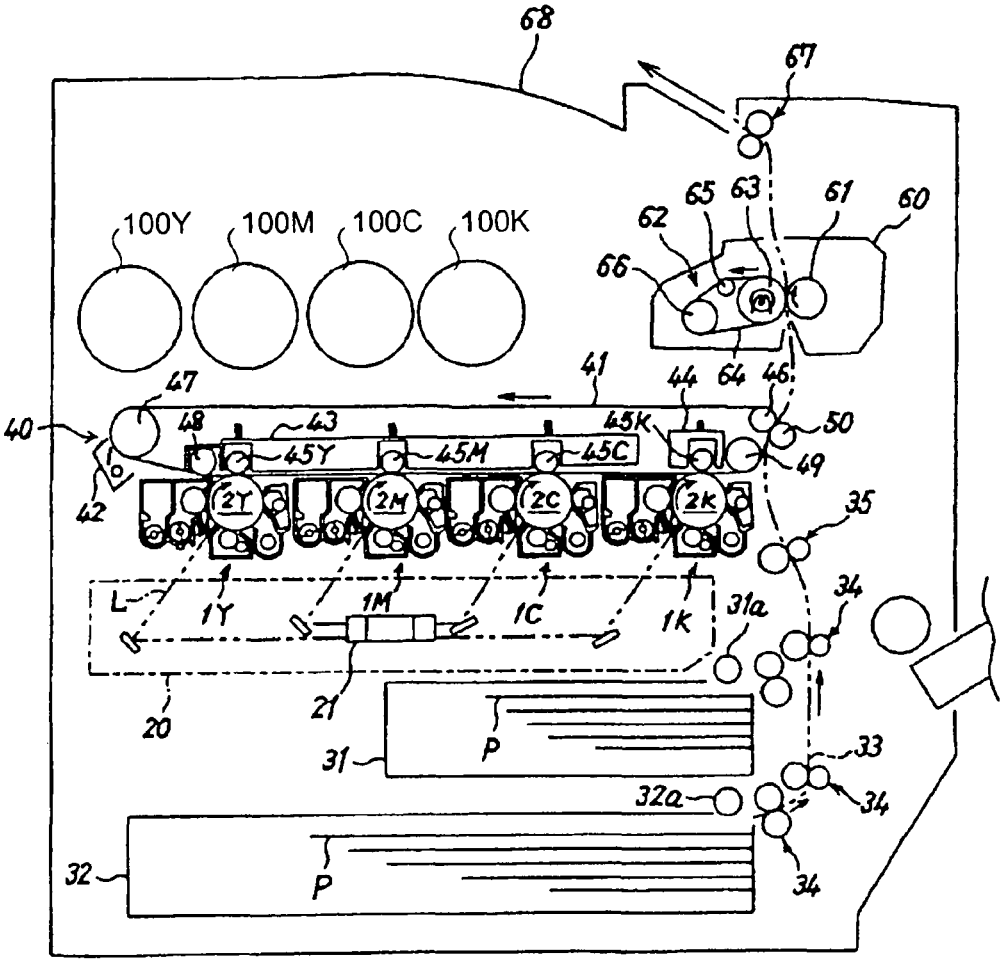
FIG. 1 is a schematic of an internal structure of a printer according to an embodiment.

FIG. 1 is a schematic of an internal structure of the printer. The printer includes four process cartridges 1Y, 1M, 1C, and 1K for creating toner images of yellow, magenta, cyan, and black (hereinafter, "Y, M, C, and K") colors, respectively. The process cartridges 1Y, 1M, 1C, and 1K use toner of different colors Y, M, C, and K, but have the same structure, and are replaced when they reach their end of life.

Figure 2:
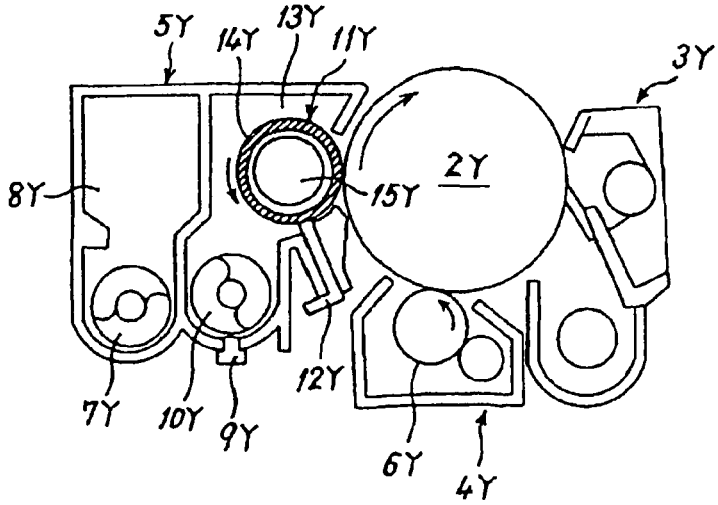
FIG. 2 is a detailed side view of a process cartridge for Y (Yellow) shown in FIG. 1.

The process cartridge 1Y for creating a Y toner image is taken as an example in FIG. 2. The process cartridge 1Y includes a photosensitive drum 2Y, a drum cleaning unit 3Y, a decharging unit (not shown), a charging unit 4Y, and a developing unit 5Y. The process cartridge 1Y is detachable from the printer, and consumables can be replaced. The process cartridges 1M, 1C, and 1K also include photosensitive drums 2M, 2C, and 2K, respectively.

The charging unit 4Y uniformly charges a surface of the photosensitive drum 2Y that is rotated in a clockwise direction by a driving unit (not shown). The charging unit 4Y charges the photosensitive drum 2Y by causing a charging roller 6Y, which is driven and rotated in a counterclockwise direction, to contact the photosensitive drum 2Y, and applying a charging bias by a power supply (not shown). A charging brush can be employed to contact the photosensitive drum 2Y, instead of the charging roller 6Y. Moreover, the charging unit 4Y can be a scortoron charger that performs a non-contact charging process on the photosensitive drum. The charged surface of the photosensitive drum 2Y is scanned by being exposed to a laser light emitted from an optical writing unit, so as to hold an electrostatic latent image for Y.

The developing unit 5Y includes a first developer accommodating section BY in which a first transporting screw 7Y is disposed. Moreover, the developing unit 5Y has a second developer accommodating section 13Y equipped with a toner density sensor (hereinafter, "T sensor") 9Y formed by a magnetic permeability sensor, a second transporting screw 10Y, a developing roll 11Y, and a doctor blade 12Y. These two developer accommodating sections accommodate a Y developer (not shown), composed of a magnetic carrier and negatively charged Y toner. The first transporting screw 7Y carries the developer Y inside the first developer accommodating section 8Y from a front side as viewed in the diagram to a back side by being driven and rotated by a driving unit (not shown). The developer Y then enters into the second developer accommodating section 13Y through a continuous opening (not shown) provided in a partition wall between the first developer accommodating section 8Y and the second developer accommodating section 13Y. The second transporting screw 10Y in the second developer accommodating section 13Y carries the developer Y from the front side as viewed in the diagram to the back side by being driven and rotated by a driving unit (not shown). Toner density of the developer Y being carried is detected by the T sensor 9Y fixed at a bottom of the second developer accommodating section 13Y. Thus, on an upper side of the second transporting screw 10Y, the developing roll 11Y including a magnet roller 15Y inside a non-magnetic pipe 14Y, driven and rotated in the counterclockwise direction, is disposed in parallel. The developer Y carried by the second transporting screw 10Y is drawn up on a surface of the non-magnetic pipe 14Y by a magnetic force generated by the magnet roller 15Y. Then, after the thickness of a layer of the developer Y is regulated by the doctor blade 12Y disposed with a predetermined distance between the non-magnetic pipe 14Y, the developer Y is carried up to a developing area facing the photosensitive drum 2Y, and the toner Y adheres to the electrostatic latent image for Y on the photosensitive drum 2Y. Accordingly, a Y toner image is formed on the photosensitive drum 2Y. The Y developer in which the Y toner has been consumed by developing is returned to the second transporting screw 10Y by rotation of the non-magnetic pipe 14Y. As the Y developer is carried up to a front side as viewed in the diagram, it returns to the first developer accommodating section BY through the continuous opening.

A detection result of the magnetic permeability of the Y developer by the T sensor 9Y is transmitted as a voltage signal to a controlling section (not shown). Since the magnetic permeability of the Y developer is correlated with the toner density of the Y developer, the T sensor outputs a voltage of a value corresponding to the toner density of the Y toner. The controlling section is equipped with a Random Access Memory (RAM) that stores data of Vtref for Y that is a target value of the output voltage from the T sensor 9Y, and of Vtref for M, Vtref for C, and Vtref for K, which are target values of the output voltage from the T sensor 9Y for the M, C, and K installed in the other developing units. The developing unit 5Y compares the value of the output voltage from the T sensor 9Y and the Vtref for Y, and drives a toner supplying unit for Y, for a time corresponding to a result of comparison. Accordingly, an appropriate amount of the Y toner is supplied in the first developer accommodating section 8Y for the Y developer, in which the density of the Y toner has reduced by consumption. Therefore, the density of the Y toner of the Y developer in the second developer accommodating section 13Y is maintained in a predetermined range. A similar toner supply control is performed for the developers of the process cartridges (1M, 1C, and 1K) for other colors.

The Y toner image formed on the photosensitive drum 2Y is subjected to an intermediate transfer to an intermediate transfer belt. The drum cleaning unit 3Y removes toner remaining on the surface of the photosensitive drum 2Y after the intermediate transfer process. The surface of the photosensitive drum 2Y is decharged by the decharging unit. Due to the decharging, the surface of the photosensitive drum 2Y is initialized and is ready for the next image formation. In the process cartridges 1M, 1C, and 1K shown in FIG. 1 M, C, and K toner images are similarly formed on photosensitive drums 2M, 2C, and 2K, and are transferred to the intermediate transfer belt.

In FIG. 1, beneath the process cartridges 1Y, 1M, 1C, and 1K, an optical writing unit 20 is disposed. The optical writing unit 20, which is a latent-image forming unit, radiates a laser beam L based on image information on each photosensitive drum in each of the process cartridges 1Y, 1M, 1C, and 1K. Thus, electrostatic latent images for Y, M, C, and K are formed on the photosensitive drums 2Y, 2M, 2C, and 2K, respectively. The optical writing unit 20 deflects the laser beam L emitted from a light source by a polygon mirror 21 driven and rotated by a motor, and radiates the laser beam L on the photosensitive drums 2Y, 2M, 2C, and 2K.

Beneath the optical writing unit 20, a first paper feeding cassette 31 and a second paper feeding cassette 32 are disposed such that they overlap in a vertical direction. In each of these paper feeding cassettes, sheets of transfer paper P are stacked. A first paper feeding roller 31*a* and a second paper feeding roller 32*a* are in contact with a top sheet of transfer paper P in the first paper feeding cassette 31 and the second paper feeding cassette 32, respectively. When the first paper feeding roller 31*a* is driven and rotated in a counterclockwise direction by a driving unit (not shown), the transfer paper P at the top in the first paper feeding cassette 31 is discharged towards a paper feeding passage 33 arranged along a vertical direction on the right side of the cassettes as viewed in the diagram. Moreover, when the second paper feeding roller 32*a* is driven and rotated in a counterclockwise direction by a driving unit (not shown), the transfer paper P at the top in the second paper feeding cassette 32 is discharged towards the paper feeding passage 33. A plurality of pairs of transporting rollers 34 are disposed along the paper feeding passage 33, and the transfer paper P fed to the paper feeding passage 33 is pinched between these pairs of transporting rollers 34 and is carried towards an upper side of the paper feeding passage 33.

At a tail end of the paper feeding passage 33 a pair of registering rollers 35 is disposed. As the transfer paper P that is fed by the pair of transporting rollers 34 is pinched between the pair of registering rollers 35, the rotation of both the rollers stops for a time. Then, the pair of registering rollers 35 transfers the transfer paper P at an appropriate timing towards a secondary transfer nip.

Above the process cartridges 1Y, 1M, 1C, and 1K is provided an intermediate transferring unit 40 including an intermediate transfer belt 41 that moves endlessly in the counterclockwise direction. The intermediate transferring unit 40 further includes a belt cleaning unit 42, a first bracket 43, a second bracket 44, four primary transfer rollers 45Y, 45M, 45C, and 45K, a secondary transfer back-up roller 46, a drive roller 47, an auxiliary roller 48, and a tension roller 49. The intermediate transfer belt 41 is stretched over these eight rollers, and moves in the counterclockwise direction by being driven and rotated by the drive roller 47. The intermediate transfer belt 41 is pinched between the four primary transfer rollers 45Y, 45M, 45C, and 45K and the photosensitive drums 2Y, 2M, 2C, and 2K, forming primary transfer nips, respectively. On a reverse face (peripheral surface inside the loop) of the intermediate transfer belt 41, a transfer bias of a polarity opposite to that of the toner (for example, positive) is applied. As the intermediate transfer belt 41 passes over the primary transfer nips for the Y, M, C, and K one after another, the Y, M, C, and K toner images on the photosensitive drums 2Y, 2M, 2C, and 2K are superimposed and transferred on a front face of the intermediate transfer belt 41. Thus, a four-color superimposed toner image (hereinafter, "four-color toner image") is formed on the intermediate transfer belt 41.

The secondary transfer back-up roller 46 forms a secondary transfer nip by pinching the intermediate transfer belt 41 with a secondary transfer roller 50 that is disposed on an outer side of the intermediate transfer belt 41. The pair of registering rollers 35 described earlier feeds the transfer paper P towards the secondary transfer nip at a timing synchronized with the four-color toner image on the intermediate transfer belt 41. The four-color toner image on the intermediate transfer belt 41 is subjected to a secondary transfer, so as to be transferred to the transfer paper P at the secondary transfer nip. The secondary transfer is performed by nip pressure and a secondary transfer electric field formed between the secondary transfer back-up roller 46 and the secondary transfer roller 50 applied with a secondary transfer bias. Combined with a white color of the transfer paper, the four-color toner image becomes a full-color toner image.

Toner remaining after the secondary transfer is adhered to the intermediate transfer belt 41 after passing through the secondary transfer nip. This toner is cleaned by the belt cleaning unit 42.

Above the secondary transfer nip, a fixing unit 60 including a pressurizing roller 61 and a fixing belt unit 62 is disposed. The fixing belt unit 62 includes a fixing belt 64 that moves endlessly in the counterclockwise direction, being stretched over a heating roller 63, a tension roller 65, and a drive roller 66. The heating roller 63 includes a heat generating source such as a halogen lamp and heats up the fixing belt 64 from a reverse side. The pressurizing roller 61 is driven and rotated in the clockwise direction, and is brought in contact with a front face of the fixing belt 64, opposite to the heating roller 63. Thus, a fixing nip is formed between the pressurizing roller 61 and the heating roller 63.

The transfer paper P that passes the secondary transfer nip, after being separated from the intermediate transfer belt 41, is fed into the fixing unit 60. When it is carried from the lower side towards the upper side in the diagram while being pinched in the fixing nip, it is heated by the fixing belt 64, and pressurized, so that the full-color toner image is fixed onto the transfer paper P.

After the fixing process, the transfer paper P is discharged out from the printer after passing through a pair of discharge rollers 67. On an upper surface of a casing of the printer, there is a stacking section 68, and the transfer paper P discharged from the printer by the pair of discharge rollers 67 is stacked one after another in the stacking section 68.

On an upper side of the intermediate transferring unit 40, four toner cartridges 100Y, 100M, 100C, and 100K that accommodate Y, M, C, and K toners are disposed. The Y, M, C, and K toners in the toner cartridges 100Y, 100M, 100C, and 100K are supplied to the developing units of the processing cartridges 1Y, 1M, 1C, and 1K. Each of these toner cartridges 100Y, 100M, 100C, and 100K are detachable from the process cartridges 1Y, 1M, 1C, and 1K, respectively.

In the printer, the four process cartridges 1Y, 1M, 1C, and 1K, the optical writing unit 20, and the intermediate transferring unit 40 etc. form a toner-image forming unit that forms a toner image on transfer paper.

Figure 3:
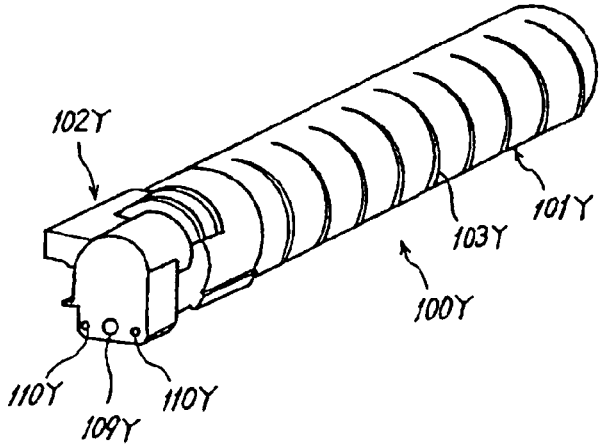
FIG. 3 is a perspective outer view of the toner cartridge for Y.

FIG. 3 is a perspective view showing the toner cartridge 100Y. The toner cartridge 100Y includes a bottle 101Y that accommodates Y toner (not shown) and a cylinder shaped holder 102Y. The holder 102Y is engaged with a front end of the bottle 101Y such that it covers an opening at a front end of the bottle 101Y, and holds the bottle 101Y so that the bottle 101Y can rotate. A protrusion 103Y in a form of a screw protrudes from an outer side towards an inner side of the bottle 101Y, along its peripheral surface. When the bottle 101Y is rotated by a drive system (not shown), Y toner in the bottle 101Y moves along the protrusion 103Y from a bottom of the bottle 101Y towards a front end side of the bottle 101Y. Then, the Y toner enters into the holder 102Y through the opening that is provided on the front end of the bottle 101Y, which is a toner accommodating receptacle.

On an end face of the holder 102Y in an axial direction of the bottle, a nozzle receiving opening 109Y is formed. This nozzle receiving opening 109Y is for receiving a suction nozzle, which is fixed to a side of the printer. On both sides of the nozzle receiving opening 109Y, there are positioning-pin receiving openings 110Y, each having a diameter slightly smaller than that of the nozzle receiving opening. These positioning-pin receiving openings 110Y are formed at a position shifted from an axis of rotation of the bottle 101Y. Moreover, a pin insertion passage (not shown) is formed inside each of the positioning-pin receiving openings 110Y, extending along a direction parallel to the direction of axis of rotation of the bottle 101Y. The bottle 101Y is made of a resin material having high rigidity, so as not to be deformed by an impact when rotated by a driving gear.

Figure 4:
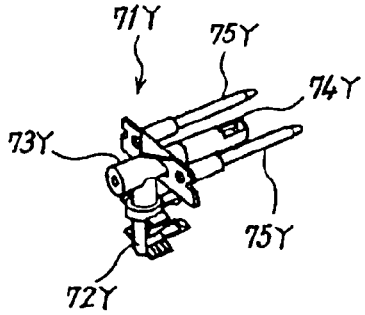
FIG. 4 is a perspective of a cartridge engaging section for Y in a toner replenishing unit.

FIG. 4 is a perspective view showing a cartridge engaging section 71Y that is a part of a toner replenishing unit (described later). This cartridge engaging section 71Y is fixed on an upper end of a transporting pipe 72Y for carrying Y toner such that a suction nozzle 73Y that is a pipe member extends in a horizontal direction. On a front end portion of the suction nozzle 73Y, a toner receiving opening 74Y for receiving Y toner is formed. Moreover, on both sides of the suction nozzle 73Y, positioning pins 75Y in the form of a rod are formed, and fixed so that they extend in the horizontal direction (a direction parallel to the axis of rotation of the bottle). A front end portion of the positioning pin 75Y that is a protrusion of the cartridge engaging section 71Y, which is a positioning member, sticks out further than the front end of the suction nozzle 73Y. Cartridge engaging sections 71M, 71C, and 71K for the colors other than Y have the same configuration as the cartridge engaging section 71Y, and also include transporting pipes 72M, 72C, and 72K, respectively.

When setting the toner cartridge 100Y shown in FIG. 3 on a toner replenishing unit, the two positioning pins 75Y of the cartridge engaging section 71Y shown in FIG. 4 are inserted into the two positioning-pin receiving openings 110Y of the holder 102Y. Thus, the toner cartridge for Y is fixed not only to the toner replenishing unit but also to the printer. The suction nozzle 73Y shown in FIG. 4 is inserted into the nozzle receiving opening 109Y of the toner cartridge for Y shown in FIG. 3.

Figure 5:
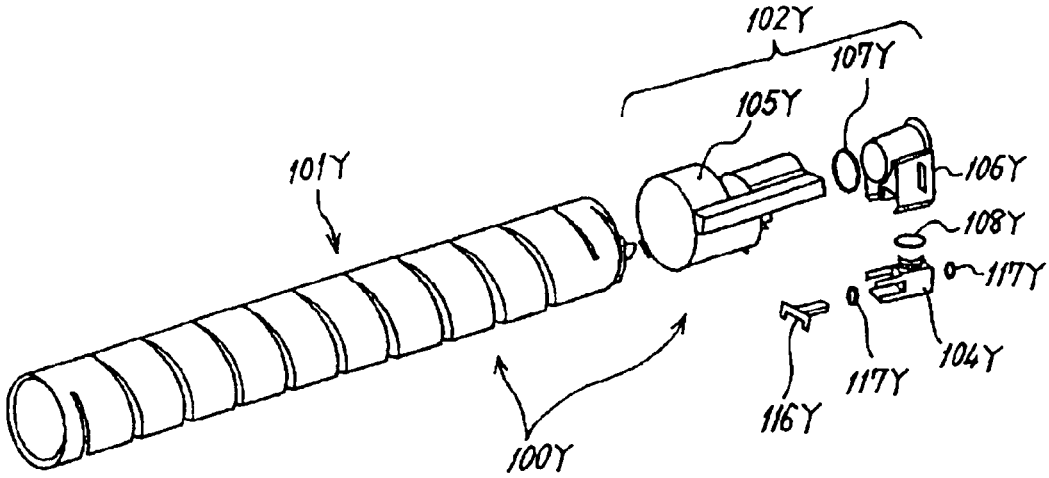
FIG. 5 is a diagram showing a disassembled toner cartridge.

FIG. 5 is an exploded perspective view of the toner cartridge 100Y. The holder 102Y that is a receptacle holding member of the toner cartridge 100Y includes an engaging section that engages with the bottle 101Y and a nozzle inserting section 104Y formed separately. The manufacturing process is facilitated as these sections are formed separately.

Moreover, the engaging section has a cap 105Y that covers an opening (not shown) on a front end of the bottle 101Y while engaging with the bottle 101Y, and a toner storage section 106Y that temporarily stores the toner. The cylindrical toner storage section 106Y has a diameter smaller than an inner diameter of the cylindrical cap 105Y, so as to fit into the cap 105Y. An O ring 107Y made of rubber, which is a non-porous material, is provided between the toner storage section 106Y and the cap 105Y. This maintains a superior airtightness between an inner peripheral surface of the cap 105Y and an outer peripheral surface of the toner storage section 106Y.

A dent is formed on a lower portion of the toner storage section 106Y, and the nozzle inserting section 104Y is fitted in this dent. An O ring 108Y made of rubber, which is a non-porous material, is provided between the toner storage section 106Y and the nozzle inserting section 104Y. This maintains a high airtightness between a recessed inner peripheral surface of the toner storage section 106Y and a protruded outer peripheral surface for fitting the nozzle inserting section 104Y.

Figure 6:
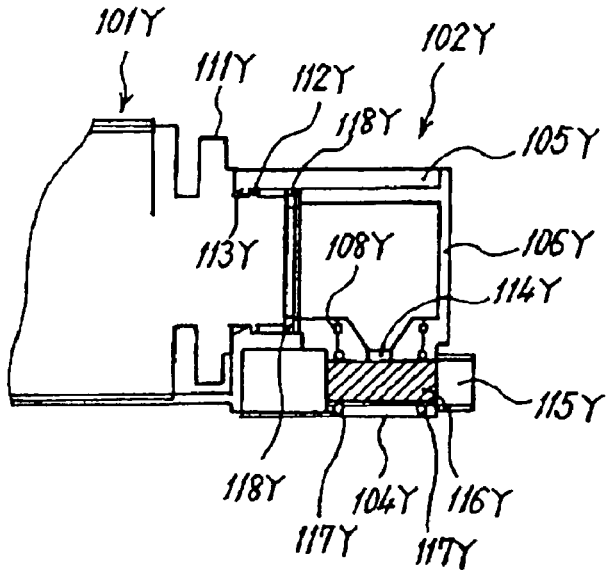
FIG. 6 is a cross-sectional view showing a front end of the toner cartridge before being set on the toner replenishing unit.

FIG. 6 is a cross-sectional view showing a front end of the toner cartridge 100Y before being set in the toner replenishing unit. A cylindrical front end portion of the bottle 101Y has a diameter smaller than that of a main unit of the bottle 101Y (hereinafter, "smaller portion"), and an opening is formed at a front end of this smaller portion. A gear 111Y having a gear wheel for engaging with a driving gear sticks out from a peripheral surface of the smaller portion. A hitching section 112Y that sticks out a little from an external peripheral surface of the smaller portion is formed ahead of the gear 111Y towards the front end side of the bottle 101Y. A cylindrical space for receiving the smaller portion of the bottle 101Y is formed in the cap 105Y of the holder 102Y. A protrusion 113Y sticks out from inner peripheral surface of the cap 105Y. The smaller portion is rotatably engaged into the cap 105Y, such that the hitching section 112Y passes over the protrusion 113Y to be hooked inside the cap 105Y.

In the nozzle inserting section 104Y, a fitting protrusion sticks out from an upper surface of a nozzle in the form of a pipe, and this fitting protrusion is fitted to a bottom of the toner storage section 106Y inside the cap 105Y. A connecting passage 114Y is formed in the fitting protrusion, and this connecting passage 114Y connects to an insertion passage 115Y that extends in a direction parallel to the axial direction of the bottle 101Y, in the nozzle. The connecting passage 114Y extends straight in a direction orthogonal to the direction of axis of rotation of the bottle 101Y, and therefore, the Y toner can drop by self-weight into the suction nozzle 73Y without being stagnated. A rod-shaped shutter member 116Y has the same diameter as that of the suction nozzle (73Y) is slidably inserted into the insertion passage 115Y. Accordingly, when the opening of the connecting passage 114Y is closed by the shutter member 116Y and when the suction nozzle 73Y is inserted into the insertion passage 115Y, the airtightness between an outside of the holder 102Y and the connecting passage 114Y can be maintained the same. Thus, when the cartridge that has the suction nozzle 73Y inserted into the connecting passage 114Y is not set, it is possible to prevent toner from leaking outside from the toner storage section 106Y through the connecting passage 114Y. Furthermore, when the cartridge is set, deterioration in the transporting ability of toner by air suction is prevented effectively. Since the shutter member 116Y is positioned immediately under the connecting passage 114Y, the connecting passage 114Y and the insertion passage 115Y are shut from each other. An end of the insertion passage 115Y corresponds to the nozzle receiving opening 109Y shown in FIG. 3.

The toner entering into the toner storage section 106Y from the smaller portion falls by self-weight and accumulates in the connecting passage 114Y of the nozzle inserting section 104Y. The fitting protrusion for fitting the nozzle inserting section 104Y into the toner storage section 106Y functions as a bottom of the toner storage section 106Y. Since the connecting passage 114Y of the fitting protrusion has a conical shape, it functions as a hopper that collects toner at the bottom due to a taper. Thus, the toner can drop smoothly. Since a front end of the connecting passage 114Y is closed by the shutter member 116Y, the toner does not flow in the insertion passage 115Y from the connecting passage 114Y. Moreover, toner is prevented from leaking out from the insertion passage 115Y before the toner cartridge 100Y is set. Furthermore, toner can flow in from the toner storage section 106Y to the suction nozzle 73Y, as the opening automatically opens when the cartridge is set.

Figure 7:
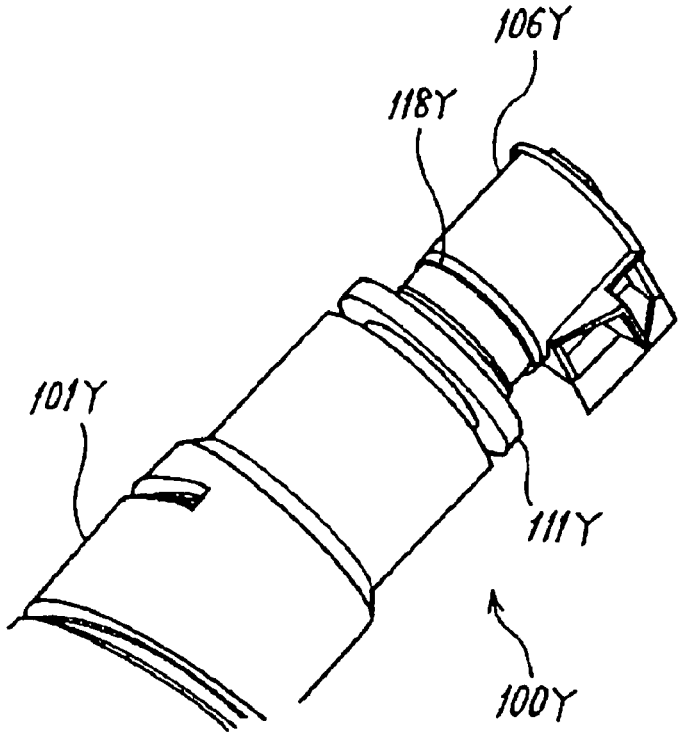
FIG. 7 is a perspective view showing the front end of the toner cartridge.

FIG. 7 is a perspective view showing a front end portion of the toner cartridge 100Y. In this diagram, for the sake of expediency, the cap (105Y) of the holder 102Y is omitted. A ring seal 118Y in the form of a ring made of sponge, which is a porous as well as elastic material, is fixed by sticking to an end portion of the side of the bottle 101Y in the toner storage section 106Y. As shown in FIG. 6, the front end of the bottle 101Y rotatably engaged with the cap 105Y abuts against the ring seal 118Y fixed to the end portion of the toner storage section 106Y, so that the bottle 101Y is prevented from shifting. This improves the airtightness between an inner peripheral surface of the bottle 101Y that is a toner accommodating receptacle and an outer peripheral surface of the cap 105Y.

While setting the toner cartridge 100Y on a cartridge mounting platform of the toner replenishing unit, a door (not shown), provided on a side plate of the casing of the printer, is opened. As this door is opened, the cartridge mounting platform of the toner replenishing unit in the casing is exposed. The cartridge mounting platform is provided with four parallel dents in the form of a half cylinder for mounting parallel the four toner cartridges 100Y, 100M, 100C, and 100K. An operator holds the toner cartridge 100Y such that the holder 102Y is positioned at a front end. Then, after mounting the holder 102Y on an end of the dent for Y from among the four half cylindrical shaped dents provided on the cartridge mounting platform, the entire cartridge is moved by sliding along the direction of axis of rotation of the bottle such that the entire cartridge is inserted. By this sliding movement, the toner cartridge 100Y is inserted up to a predetermined position and set on the cartridge mounting platform.

In FIG. 4 mentioned earlier, the two positioning pins 75Y of the cartridge engaging section 71Y in the toner replenishing unit stick out more than the front end of the suction nozzle 73Y. Moreover, the positioning pins 75Y are tapered, such that the tips are narrow. Half way through the operation of inserting the toner cartridge into the cartridge mounting platform, the tapering tips of these two positioning pins 75Y enter into the two positioning-pin receiving openings 110Y of the toner cartridge 100Y shown in FIG. 3. Then, when the toner cartridge 100Y is inserted further, the rear end sides of the positioning pins 75Y, which are wider than the tips, enters the positioning-pin receiving opening 110Y. This fixes a position of the toner cartridge 100Y in a direction orthogonal to the direction of the axis of rotation, on the cartridge mounting platform.

After this position is fixed, the suction nozzle 73Y in the cartridge engaging section 71Y of the toner replenishing unit shown in FIG. 4 enters the nozzle receiving opening 109Y of the holder 102Y shown in FIG. 3. Then, at a point where the suction nozzle 73Y is pushed a certain extent into the insertion passage (115Y), the setting of the toner cartridge 100Y is completed. Thus, the toner cartridge can be installed in and detached from the side surface of the image forming apparatus.

Figure 8:
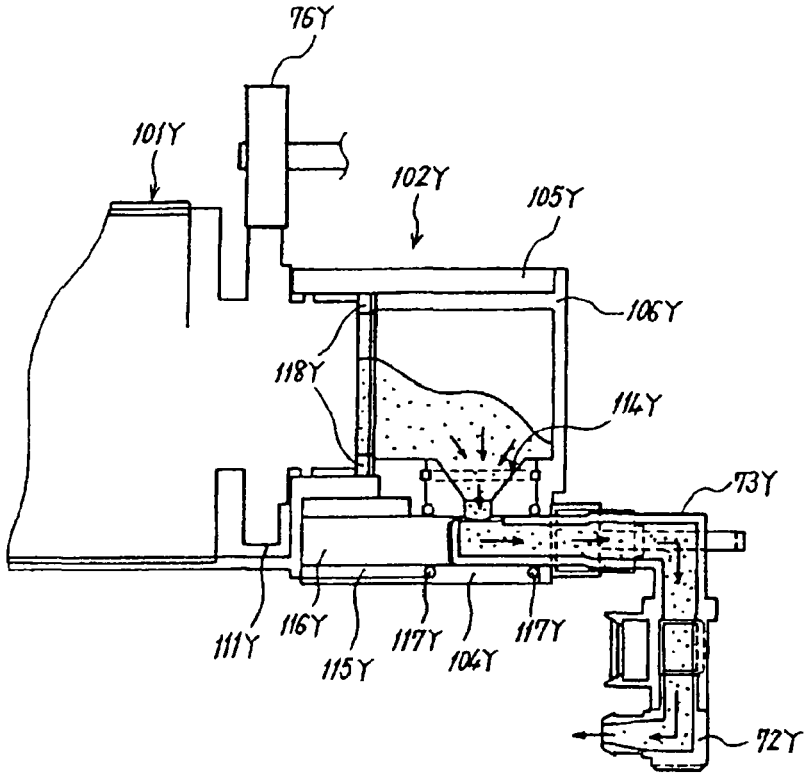
FIG. 8 is a cross-sectional view showing the front end of the toner cartridge with the toner replenishing unit being set.

FIG. 8 is a cross-sectional view showing the front end portion of the toner cartridge 100Y set in the toner replenishing unit. When the toner cartridge 100Y is set on the cartridge mounting platform of the toner replenishing unit (not shown), the suction nozzle 73Y fixed to the toner replenishing unit is inserted into the insertion passage 115Y of the nozzle inserting section 104Y in the holder 102Y. At this time, in the insertion passage 115Y, the shutter member 116Y positioned right under the connecting passage 114Y moves by sliding from the right side to the left side in the diagram by being pushed to the front end of the suction nozzle 73Y inserted into the insertion passage 115Y. Then, the shutter member 116Y moves away from the position right under the connecting passage 114Y, to a position right under the toner receiving opening (74Y in FIG. 4) provided on the front end portion of the suction nozzle 73Y. Thus, the toner storage section 106Y and the suction nozzle 73Y are connected via the connecting passage 114Y of the nozzle inserting section 104Y. Two O rings 117Y made of rubber, which is a non-porous material, are fixed on an inner peripheral surface of the insertion passage 115Y. The suction nozzle 73Y and the shutter member 116Y slide in the insertion passage 115Y while penetrating an inner portion of the O rings 117Y. One of the two O rings 117Y is located towards an inlet side (nozzle receiving opening) from the connecting passage 114Y and seals this location between the insertion passage 115Y and the suction nozzle 73Y, which is a pipe member. Accordingly, an inflow of air from a gap between an inlet (toner receiving opening) of the insertion passage 115Y and the suction nozzle 73Y, to the insertion passage 115Y is blocked. Another O ring 117Y is located towards an outlet side from the connecting passage 114Y, and seals this location between the insertion passage 115Y and the suction nozzle 73Y. Accordingly, an inflow of air from a gap between the outlet of the insertion passage 115Y and the suction nozzle 73Y is blocked. As a result, toner conveyance by suction can be prevented from being hampered.

The toner cartridge 100Y that is set on the toner replenishing unit (not shown), causes the gear 111Y of the bottle 101Y to engage with a driving gear 76Y fixed to the toner replenishing unit. As the driving gear 76Y is driven and rotated by a driving source (not shown), due to the engagement between the driving gear 76Y and the gear 111Y, the bottle 101Y rotates while being held by the holder 102Y. Accordingly, Y toner in the bottle 101Y is carried from a rear end side of the bottle 101Y to a front end side of the bottle 101Y, and flows into the toner storage section 106Y of the holder 102Y. Then, Y toner is accumulated in the connecting passage 114Y that has become a bottom of the toner storage section 106Y.

Due to a counteraction of the rotational motion of the bottle 101Y, it is assumed that the holder 102Y that rotatably holds the bottle 101Y is about to rotate on the cartridge mounting platform. However, an inner wall of the pin inserting passage inside the positioning-pin receiving openings 110Y hitches onto the positioning pin 75Y. The rotation of the holder 102Y is prevented, and therefore, the holder 102Y is prevented from being misaligned.

In another example, the protrusion and the recession can be reversed. Specifically, instead of the positioning pins 75Y, the cartridge engaging section 71Y can include a recessed section that extends in a direction parallel to the axis of rotation of the bottle. Furthermore, instead of the pin inserting passage, the holder 102Y can include a protruding section extending in a direction parallel to the axis of rotation of the bottle.

In an area of the transporting pipe 72Y connected to the suction nozzle 73Y (not shown), a suction pump is connected, and air and toner in the transporting pipe 72Y is sucked by operation of this suction pump. As the air and toner are sucked, the suction force is transmitted to the connecting passage 114Y and the toner storage section 106Y via the transporting pipe 72Y and the suction nozzle 73Y. Then, the Y toner in the toner storage section 106Y and the connecting passage 114Y is sucked into the suction nozzle 73Y.

As described above, the gap between the insertion passage 115Y and the suction nozzle 73Y inserted into the insertion passage 115Y is sealed by the O ring 117Y that is a non-porous sealing member. On the other hand, a gap between the cap 105Y of the holder 102Y and the bottle 101Y engaged with the cap 105Y is sealed by the ring seal 118Y that is a porous sealing member. According to this structure, the airtightness in the gap between the insertion passage 115Y and the suction nozzle 73Y is superior than an airtightness in the gap between the bottle 101Y and the cap 105Y. As a negative pressure is developed in the suction nozzle 73Y, the connecting passage 114Y, and the toner storage section 106Y, by suction of the suction pump, air flows in from outside through the gap between the bottle 101Y and the cap 105Y, where the airtightness is inferior. Concretely, the air reaches the porous ring seal 118Y through a gap between the inner side of the cap 105Y and an outer side of the bottle 101Y. Since the airtightness between the insertion passage 115Y and the suction nozzle 73Y is maintained well by the O ring 117Y, air is prevented from flowing through this portion into the suction nozzle 73Y. Therefore, suction force is exerted appropriately from the toner storage section 106Y to the suction nozzle 73Y. Thus, a stable amount of the Y toner is discharged from the toner storage section 106Y to a developing unit 5Y in the printer.

If the airtightness between the inside and the outside of the toner cartridge 100Y is too high, air does not flow into the toner cartridge at all by the suction of the suction pump. This causes the bottle 101Y to deform due to excessive negative pressure. However, in the toner cartridge 100Y, the ring seal 118Y is made of a porous material. Accordingly, the toner storage section 106Y has a little negative pressure due to the toner suction, so that a proper amount of air flows into the toner storage section 106Y through the ring seal 118Y. This prevents the deformation of the bottle 101Y caused by to the excessive negative pressure.

The toner cartridges 100M, 100C, and 100K have the same structure as the toner cartridge 100Y.

Figure 9:
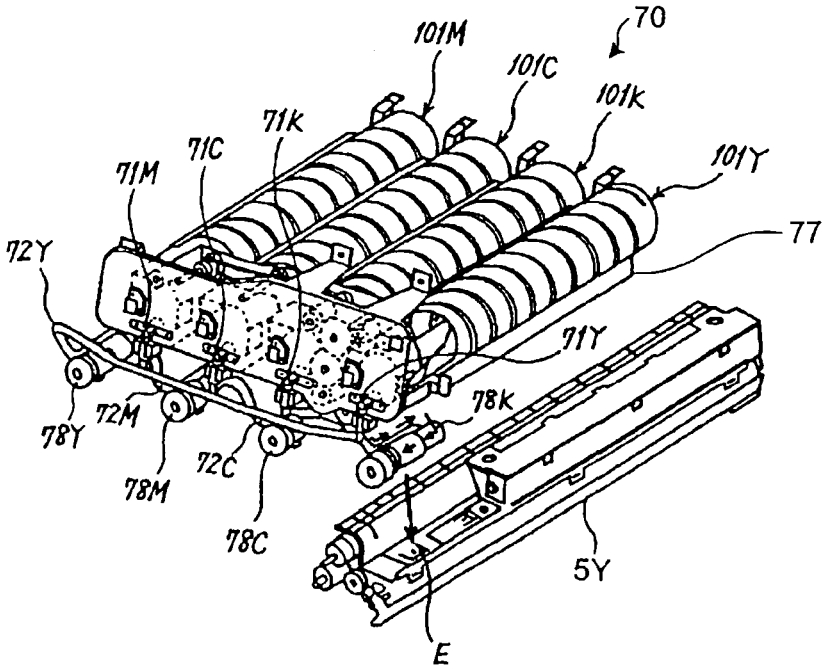
FIG. 9 is a perspective view showing the toner replenishing unit and its surrounding structure.

FIG. 9 is a perspective view showing a toner replenishing unit 70 and its surrounding structure. The toner replenishing unit 70 includes a cartridge mounting platform 77, the four cartridge engaging sections 71Y, 71M, 71C, and 71K, and four suction pumps 78Y, 78M, 78C, and 78K. The cartridge mounting platform 77 has four dents in the form of a half cylinder for mounting in parallel the four toner cartridges 100Y, 100M, 100C, and 100K. On a lower side of the cartridge mounting platform 77, four developing units are disposed in positions right under the toner cartridges of corresponding colors. In the same diagram, for the sake of expediency, only a developing unit 5Y from among the four developing units is shown.

On a side surface of the casing of the printer, the door that opens when replacing a toner cartridge is provided. As this door opens, the back side of the toner replenishing unit 70, as viewed in FIG. 9, is exposed. An operator sets the toner cartridges 100Y, 100M, 100C, and 100K by pushing them in a longitudinal direction of the bottle and sliding them on the cartridge mounting platform 77.

At one end of the cartridge mounting platform 77, an engaging section supporting plate for supporting the four cartridge engaging sections 71Y, 71M, 71C, and 71K is installed. Respective suction nozzles of the cartridge engaging sections 71Y, 71M, 71C, and 71K are inserted into nozzle insertion passages (not shown) of the toner cartridges 100Y, 100M, 100C, and 100K, which are mounted on the cartridge mounting platform 77. At ends of the transporting pipes 72Y, 72M, 72C, and 72K of the cartridge engaging sections 71Y, 71M, 71C, and 71K, the suction pumps 78Y, 78M, 78C, and 78K are connected. A toner replenishing opening E of each developing unit is positioned right under each of the suction pumps 78Y, 78M, 78C, and 78K.

Figure 10:
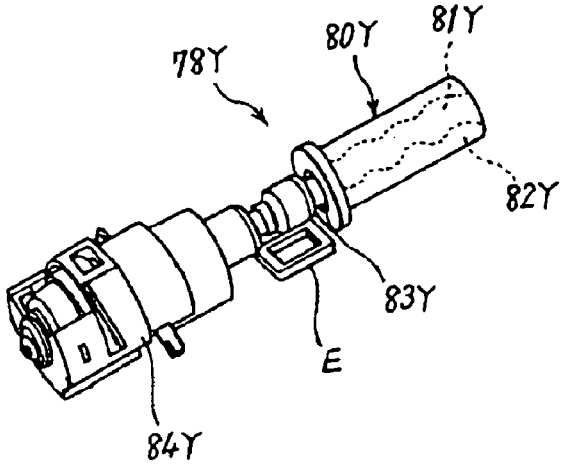
FIG. 10 is a perspective view showing a suction pump for Y in the toner replenishing unit.
Figure 11:
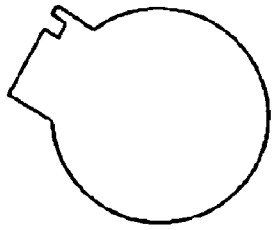
FIG. 11 is a schematic diagram showing an outline of a projection image in a direction of axis of rotation of a bottle of a holder in a toner cartridge for M (Magenta)
Figure 12:
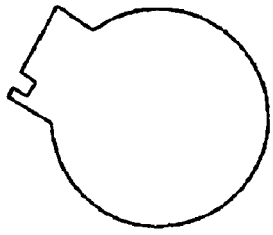
FIG. 12 is a schematic diagram showing an outline of a projection image in a direction of axis of rotation of a bottle of a holder in a toner cartridge for C (Cyan)
Figure 13:
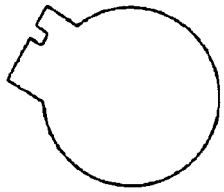
FIG. 13 is a schematic diagram showing an outline of a projection image in a direction of axis of rotation of a bottle of a holder in a toner cartridge for K (Black)

FIG. 10 is a perspective view showing the suction pump 78Y from among the four suction pumps 78Y, 78M, 78C, and 78K. This suction pump 78Y is an eccentric screw pump (popularly known as mono pump). A pump section 80Y of the suction pump 78Y includes a rotor 81Y that is processed in the form of a eccentric double-threaded screw made of a metal or a highly rigid resin, a stator 82Y made of a material such as rubber including a hollow section in the form of the double-threaded screw, and a holder made of resin that accommodates the rotor 81Y and the stator 82Y. Furthermore, the suction pump 78Y includes a delivery section 83Y, and a motor 84Y that rotates the rotor 81Y. As the rotor 81Y rotates inside the stator 82Y, negative pressure is developed at a suction side (right side in the diagram) in the pump section 80Y. Due to this negative pressure, Y toner in the toner cartridge 100Y is sucked via the transporting pipe 72Y. Then, the Y toner reaches the pump section 80Y of the suction pump 78Y and is delivered from the delivery section 83Y after passing through the stator 82Y. The Y toner that is delivered is replenished to the developing unit 5Y after passing through the toner replenishing opening of the developing unit positioned right under the delivery section 83Y. Toner is replenished in the same manner in the developing units for other colors.

As described above, the bottle in the toner cartridges 100Y, 100M, 100C, and 100K has a long-slender cylindrical shape along a direction of axis of rotation. Thus, a rotating peripheral surface can be supported easily as compared to the case of using an angular shaped bottle. If only one end of the bottle is held rotatably by the holder, the other end is apt to bend down due to the weight of the toner. As a result, a considerable load is exerted on the holding section, which might cause the toner cartridge to break. Therefore, it is necessary to support the other end side of the bottle on the platform. When the bottle is supported on the platform, and the peripheral surface of the bottle is angular, the bottle is caused to bounce. However, if the bottle is cylindrical, the bottle does not bounce, and can be supported on the platform.

As shown in FIG. 6, in the toner cartridge 100Y of this printer, the holder 102Y is structured as follows. Specifically, the toner storage section 106Y that stores the Y toner sent from the bottle 101Y and the connecting passage 114Y that connects the toner storage section 106Y and the insertion passage 115Y are positioned such that the insertion passage 115Y, the connecting passage 114Y, and the toner storage section 106Y are arranged in this order, in a direction orthogonal to the direction of axis of rotation of the bottle. Thus, the Y toner that is sent from the bottle 101Y to the toner storage section 106Y by its self-weight, can be passed through the connecting passage 114Y and dropped into the suction nozzle 73Y in the insertion passage 115Y.

In the present embodiment, a non-recycled cartridge is used. Similar results can be obtained by using a recycled cartridge, as the toner cartridges 100Y, 100M, 100C, and 100K.

FIG. 11, FIG. 12, FIG. 13, and FIG. 14 are schematic diagrams showing an outline of a projection image in the direction of axis of rotation of the bottle of the holder in the toner cartridges 100M, 100C, 100K, and 100Y for the toners M, C, K, and Y. Each diagram shows an outline of a projection image when the holder is projected from the rear end side of the bottle to the front end side of the bottle. Each shape of the projected image is different. Concretely, in each projection image, a rectangular protrusion is formed at a top left of a circle. This protrusion is formed by a guide member that sticks out from an external peripheral surface of the holder. However, the shape of these rectangular protrusions differs slightly according to each holder.

Figure 14:
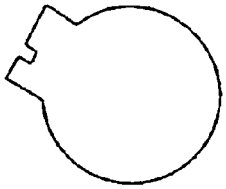
FIG. 14 is a schematic diagram showing an outline of a projection image in a direction of axis of rotation of a bottle of a holder in a toner cartridge for Y.
Figure 15:
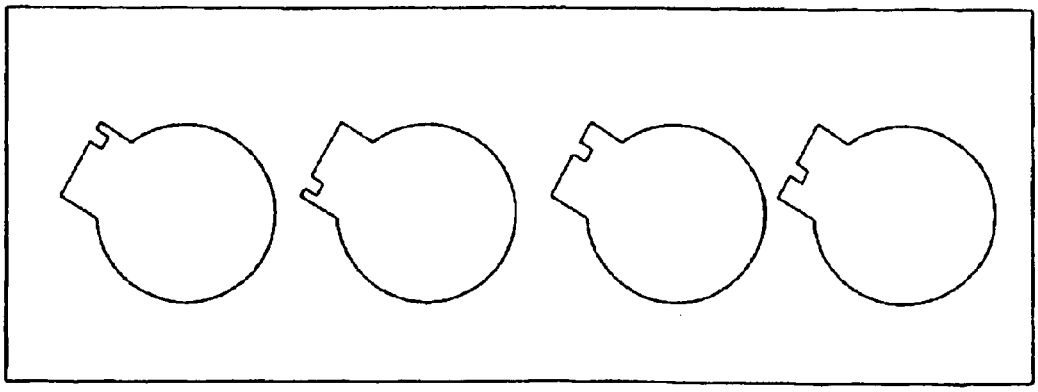
FIG. 15 is a front view showing a side plate of the same toner replenishing unit.
Figure 16:
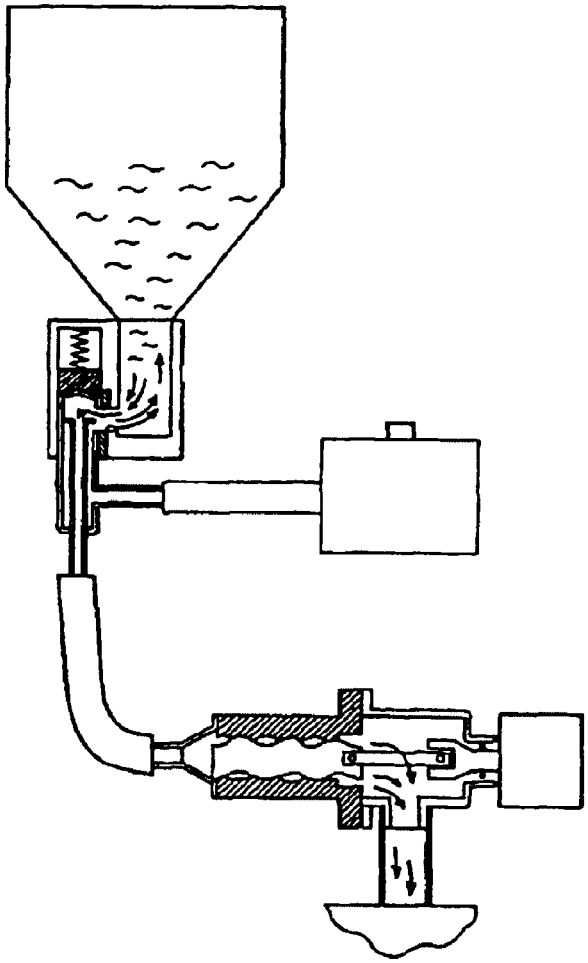
FIG. 16 is a schematic diagram showing a conventional toner replenishing unit.
Figure 17:
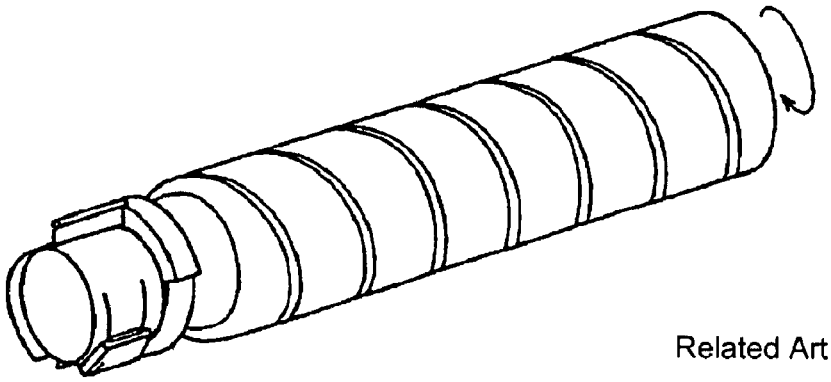
Related Art FIG.17
FIG. 17 is a perspective view showing a conventional toner cartridge.

FIG. 15 is a front view showing the side plate of the toner replenishing unit 70. When the door on the side plate of the casing of the printer is open, the side plate of the toner replenishing unit is exposed as shown in FIG. 15. This side plate has four circular shaped openings and having different shapes. A first, a second, a third, and a fourth opening counted from the left side in the diagram are configured to receive toner cartridges for M, C, K, and Y, respectively. Shapes of the first, the second, the third, and the fourth openings are same as the outline shape of the projection images of the holders shown in FIG. 11, FIG. 12, FIG. 13, and FIG. 14, respectively. For example, even if an attempt is made to insert the toner cartridge for Y having the outline shape as shown in FIG. 14 into the first opening on the far left side, the holder gets hitched onto the opening and insertion is obstructed. Thus, a toner cartridge is prevented from being set on an incorrect mounting section.

There are mainly two types of methods for recycling the toner cartridge 100Y, as described below.

In the first method of recycling, when the toner cartridge 100Y becomes empty, it is recycled by performing three steps viz. a disassembling step, a refilling step, and a reassembling step. In the disassembling step, the bottle 101Y rotatably engaged with the holder 102Y is removed by a special purpose tool. When the bottle 101Y is removed, an opening for toner discharge provided at a front end of the bottle 101Y is exposed. Next, at the refilling step, refill toner Y is refilled in the bottle 101Y through this opening. Then, at the reassembling step, the front end of the bottle 101Y is engaged with the holder 102Y, so that the toner cartridge 100Y is reassembled.

Second Method of Recycling

In the second method of recycling, when the toner cartridge 100Y becomes empty, it is recycled by performing three steps viz. a hole making step, a refilling step, and a hole-closing step. At the hole making step, a hole drilled through a bottom surface (base) of the rear end of the bottle 101Y. Next, at the refilling step, refill toner Y is refilled through the hole, and at the hole closing step, the hole is closed by welding the same resin material as that of the bottle 101Y. In another example, the new toner cartridge 100Y can have an opening formed on the bottom surface (base) of the rear end of the bottle 101Y, to be closed by sticking a sealing film. The sealing film may be peeled off or a hole may be made in the sealing film, to perform the hole making step. Moreover, at the hole making step, a location of making the hole need not be at the base of the bottle 101Y; the hole may be made on a peripheral surface.

These recycling methods can be performed for toner cartridges corresponding to any other color.

In the above embodiments, a printer that forms a full color image by using a plurality of image carriers for each color has been described. However, the present invention can be applied to an image forming apparatus that forms a full color image by forming single-color toner images of different colors on one image carrier and then superimposing and transferring them one by one to an intermediate transfer body. Moreover, the present invention can be applied as well to an image forming apparatus that forms only a single-color toner image. Furthermore, the present invention can be applied to an image forming apparatus that forms a toner image by direct recording instead of by electrophotography.

According to the present invention, a stable amount of toner is discharged to an image forming apparatus, and a toner cartridge can be set not only vertically but also horizontally so as to allow freedom in the layout.

Furthermore, according to the present invention, a toner cartridge can be installed in and detached from the side surface of an image forming apparatus.

Moreover, according to the present invention, a holder that engages with a toner bottle is prevented from rotating, and therefore, the holder is prevented from being misaligned due to rotation of the toner bottle.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

The invention claimed is:

1. A toner container, comprising:

a storage volume having a toner dispensing opening at an end thereof; and a holder, connected to the storage volume, which includes:

a cap which is connected to the storage volume at the end of the storage volume having the toner dispensing opening;

a toner storage section, different from the cap and connected to the cap, arranged to receive toner from the toner dispensing opening, an end portion of the toner storage section is covered with the cap; and a nozzle inserting section, different from the cap and toner storage section, disposed below the toner storage section and including an insertion passage configured to receive a nozzle of an image forming apparatus.

2. The toner container according to claim 1, wherein:

the cap includes a recess through which a gear protrudes.

3. The toner container according to claim 2, further comprising:

the gear which is part of the storage volume.

4. The toner container according to claim 1, wherein:

the storage volume includes a protrusion; and the cap includes a hitching section which engages with the protrusion.

5. The toner container according to claim 1, further comprising:

a seal between the end of the storage volume and the toner storage section.

6. The toner container according to claim 1, further comprising:

a rod-shaped shutter disposed within the insertion passage of the nozzle inserting section.

7. The toner container according to claim 6, wherein the nozzle inserting section includes:

a connecting passages which connects an interior of the toner storage section to the insertion passage, the connecting passage being perpendicular to the insertion passage.

8. The toner container according to claim 6, further comprising:

two O-rings around the rod-shaped shutter, one of the O-rings at one side of the insertion passage, and another of the O-rings at another side of the insertion passage.

9. The toner container according to claim 8, wherein:

the rod-shaped shutter includes a member disposed on an end of the rod-shaped shutter which is perpendicular to a length of the rod-shaped shutter.

10. The toner container according to claim 9, wherein:

the member of the rod-shaped shutter has two downward projecting elements, one on each side of the rod-shaped shutter.

11. The toner container according to claim 1, further comprising:

an O-ring disposed between the nozzle inserting section and the toner storage section, the O-ring disposed around a connecting passages which connects an interior of the toner storage section to the insertion passage.

12. The toner container according to claim 1, wherein the storage volume comprises:

a spiral which moves toner within the storage volume towards the opening thereof.

13. The toner container according to claim 1, wherein the storage volume comprises:

toner.

14. The toner container according to claim 1, wherein the holder comprises:

a protrusion having a length parallel to a length of the storage volume, a position of the protrusion corresponding to a color of toner to be dispensed by the toner container.

15. An image forming device comprising the nozzle and the toner container of claim 1.

16. A toner container, comprising:

means for containing toner having a toner dispensing opening at an end thereof; and a holder, connected to the means for containing toner, which includes:

means for capping the means for containing toner which is connected to the means for containing toner at the end of the means for containing toner having the toner dispensing opening;

means for storing toner, different from the means for capping and connected to the means for capping, arranged to receive toner from the toner dispensing opening, an end portion of the means for containing toner is covered with the means for capping; and means for receiving a nozzle, different from the means for capping and the means for storing toner, disposed below the means for storing toner and including an insertion passage configured to receive a nozzle of an image forming apparatus.

17. The toner container according to claim 16, wherein:

the means for capping includes a recess through which a gear protrudes.

18. The toner container according to claim 17, further comprising:

the gear which is part of the means for containing toner.

19. The toner container according to claim 16, wherein:

the means for containing toner includes a protrusion; and the means for capping includes a hitching section which engages with the protrusion.

20. The toner container according to claim 16, wherein the means for containing toner comprises:

toner.

* * * * *